US006504901B1

(12) United States Patent
Loxley et al.

(10) Patent No.: US 6,504,901 B1
(45) Date of Patent: Jan. 7, 2003

(54) X-RAY FOCUSING APPARATUS

(75) Inventors: Nell Loxley, Durham (GB); Ladislav Pina, Praque (CZ)

(73) Assignee: Bede Scientific Instruments Limited, Durham (GB)

( * ) Notice: Subject to any disclaimer, the term of this patent is extended or adjusted under 35 U.S.C. 154(b) by 0 days.

(21) Appl. No.: 09/744,367

(22) PCT Filed: Jul. 23, 1999

(86) PCT No.: PCT/GB99/02216

§ 371 (c)(1),
(2), (4) Date: Jan. 23, 2001

(87) PCT Pub. No.: WO00/05727

PCT Pub. Date: Feb. 3, 2000

(30) Foreign Application Priority Data

Jul. 23, 1998 (GB) ..... 9815968

(51) Int. Cl.[7] ..... G21K 1/06
(52) U.S. Cl. ..... 378/84; 378/85; 378/145
(58) Field of Search ..... 378/70, 71, 84, 378/85, 145

(56) References Cited

U.S. PATENT DOCUMENTS 4,525,853 A 7/1985 Keem et al. ..... 378/84
5,192,869 A * 3/1993 Kumakhov ..... 250/505.1
5,222,113 A 6/1993 Thieme et al. ..... 378/43
5,497,008 A * 3/1996 Kumakhov ..... 250/505.1
5,604,353 A 2/1997 Gibson et al. ..... 250/505.1
5,747,821 A 5/1998 York et al. ..... 250/505.1
6,345,086 B1 * 2/2002 Ferrandino et al. ..... 378/44
6,389,107 B1 * 5/2002 Kantsyrev et al. ..... 378/145

OTHER PUBLICATIONS

Patent Abstracts of Japan; Publication No. 01119800; Publication Date 11/05/89; Application Date Nov. 5, 1989 Feb. 11, 1987; Application No. 62277838; Applicant: Fujjitsu Ltd.; Inventor: Sugishima Kenji; "X–Ray Source".

* cited by examiner

*Primary Examiner*—David P. Porta
*Assistant Examiner*—Therese Barber
(74) *Attorney, Agent, or Firm*—Drinker Biddle & Reath LLP

(57) ABSTRACT

An X-ray focusing apparatus comprises a waveguide (3) closely coupled to an X-ray focusing mirror (5). The mirror comprises an interior reflecting surface having a rotational axis of symmetry. The waveguide may comprise a tapered polycapillary lens.

24 Claims, 6 Drawing Sheets

X-RAY FOCUSING APPARATUS

This invention relates to X-ray focusing devices for use with X-ray generators and in particular to X-ray focusing devices which utilise capillary and polycapillary lenses in combination with X-ray focusing mirrors for the close coupled focusing of X-ray beams.

The majority of X-ray generators produce X-ray beams which have a relatively large focal spot or line which requires that the generator utilises a relatively small aperture to restrict beam diameter and divergence. However, the use of small apertures results in a large loss of X-ray intensity.

It is known that X-ray focusing mirrors may be used in order to focus and thereby increase the intensity of the beam from an X-ray generator. An example of such a focusing mirror is that distributed by Bede Scientific Instruments Ltd under the Trade Mark "Micromirror". "Micromirrors" are now in commercial production and are being used in X-ray generators. The brightness achieved by using the "Micromirror" is comparable to that given by rotating anode generators with total reflection optics.

This focusing mirror comprises a cylindrical body having an axially symmetrical passage extending therethrough. There is an aperture at each end of the body which communicates with the passage. The passage has a profile which may be ellipsoidal or paraboloidal in longitudinal section, depending on requirements. An ellipsoidal profile produces a focused beam with varying divergence and focused spot size, while a paraboloidal profile produces an almost parallel, essentially non-divergent beam. The interior reflecting surface is coated in an exceptionally smooth coating of gold or similar in order to provide specular reflectivity. Typically the mirror is made of nickel and is of the order of 30 mm in length. The outside diameter of the mirror is typically 6 mm. The entry aperture is generally smaller than the exit aperture.

It is known to use capillary lenses to focus X-rays. A capillary lens conventionally comprises a number of capillary tubes bundled together. A capillary lens is capable of focusing X-ray radiation to a small diameter spot, but suffers from the disadvantage that the focused beam has relatively high divergence. In contrast an X-ray mirror can produce a beam of relatively low divergence.

In conventional use, a single X-ray focusing mirror is used to focus the source beam and thus produce a gain in intensity from the X-ray generator to the specimen. However X-ray generators provide X-ray beams which have a relatively large focal spot and therefore even when focused by the X-ray focusing mirror the beam will not be as intense as it can be. In addition, tests have shown that the smaller the dimension of the focal spot the greater increase in gain there will be through the X-ray focusing mirror. Thus, the present invention aims to provide apparatus which in combination will provide an input focal point at the entry aperture of the X-ray focusing mirror which has a diameter as close as possible to zero, thereby maximising the gain through the X-ray focusing mirror to the target specimen.

According to a first aspect of the present invention there is provided an X-ray focusing device comprising a capillary waveguide arranged on a first axis closely coupled to an X-ray focusing mirror, whereby the mirror comprises an interior reflecting surface having a rotational axis of symmetry on a second axis, said first and second axes being substantially collinear.

It will be understood to those skilled in the art that close coupling involves arranging the components of the focusing device such that the separation between them is of the order of magnitude of the length of each component or less, preferably less than 50 mm, most preferably less than 10 mm.

Preferably said interior reflecting surface is ellipsoidal, paraboloidal or conical in longitudinal section.

Preferably said capillary waveguide comprises one or more tapered capillaries arranged symmetrically about said first axis. Preferably the angle of taper of said tapered capillaries is less than 10 mrad.

Preferably the capillary waveguide is arranged to produce a focused X-ray beam of less than 10 $\mu$m diameter.

According to a preferred embodiment the capillary lens comprises a single tapered capillary having an internal profile adapted to reduce the diameter of the focal spot of an X-ray source.

According to a second aspect of the present invention there is provided an X-ray focusing device comprising a polycapillary lens arranged on a first axis closely coupled to an X-ray focusing mirror, whereby the mirror comprises an interior reflecting surface having a rotational axis of symmetry on a second axis, said first and second axes being substantially collinear.

Preferably said interior reflecting surface is ellipsoidal, paraboloidal or conical in longitudinal section.

Preferably said polycapillary lens comprises a plurality of tapered capillaries arranged such that both the diameter of the focal spot of an X-ray source and the angular divergence of the X-rays are reduced.

Preferably said capillaries comprises fibres having internal diameters of less than 10 $\mu$m, most preferably less than 2 $\mu$m.

Preferably said polycapillary lens comprises between 10 and 500, most preferably between 50 and 200 tapered capillaries.

Preferably said polycapillary lens is arranged such that its overall diameter first increases and then decreases with increasing distance from the X-ray source.

Preferably, said mirror is moveable in position relative to said waveguide. Preferably, said device further comprises a guide means for guiding said mirror in a direction parallel to the second axis, and adjustment means for adjusting the spacing of the waveguide and the mirror. Preferably, the device also comprises angular adjustment means adapted to allow angular adjustment of the mirror. Alternatively, said mirror is fixed in position relative to said waveguide.

According to a third aspect of the present invention there is provided an X-ray focusing device comprising a polycapillary lens arranged on a first axis closely coupled to a planar or non-planar X-ray target of an X-ray generator, said polycapillary lens comprising a plurality of tapered capillaries arranged such that the input end of each capillary is arranged substantially normal to the adjacent portion of said X-ray target. The polycapillary lens may be closely coupled to an X-ray focusing mirror at its end remote from the target, in accordance with the first or second aspects of the invention.

Preferably said polycapillary lens is arranged such that its overall diameter first increases and then decreases with increasing distance from the X-ray source.

According to a fourth aspect of the present invention there is provided an X-ray generating device comprising an annular electron source arranged about a tapered or conical X-ray target closely coupled to a polycapillary lens or an X-ray focusing mirror. The X-ray target may be coupled to a polycapillary lens, which is itself closely coupled to an X-ray focusing mirror at its end remote from the target, in accordance with the first or second aspects of the invention.

According to a fifth aspect of the present invention there is provided an X-ray focusing device comprising a substantially hemispherical X-ray target closely coupled to a polycapillary lens or an X-ray focusing mirror, the target comprising a plurality of channels axially orientated towards the hemispherical centre. Preferably the device is positioned such that the electron source is at the hemispherical centre. The X-ray target may be coupled to a polycapillary lens, which is itself closely coupled to an X-ray focusing mirror at its end remote from the target, in accordance with the first or second aspects of the invention. Preferably the lens or mirror is arranged such that the angle of collection of the lens or mirror is the same as the angle subtended by the hemispherical target at the hemispherical centre.

Embodiments of the invention will now be described, by way of example only, with reference to the accompanying figures, where:

Figure 1:
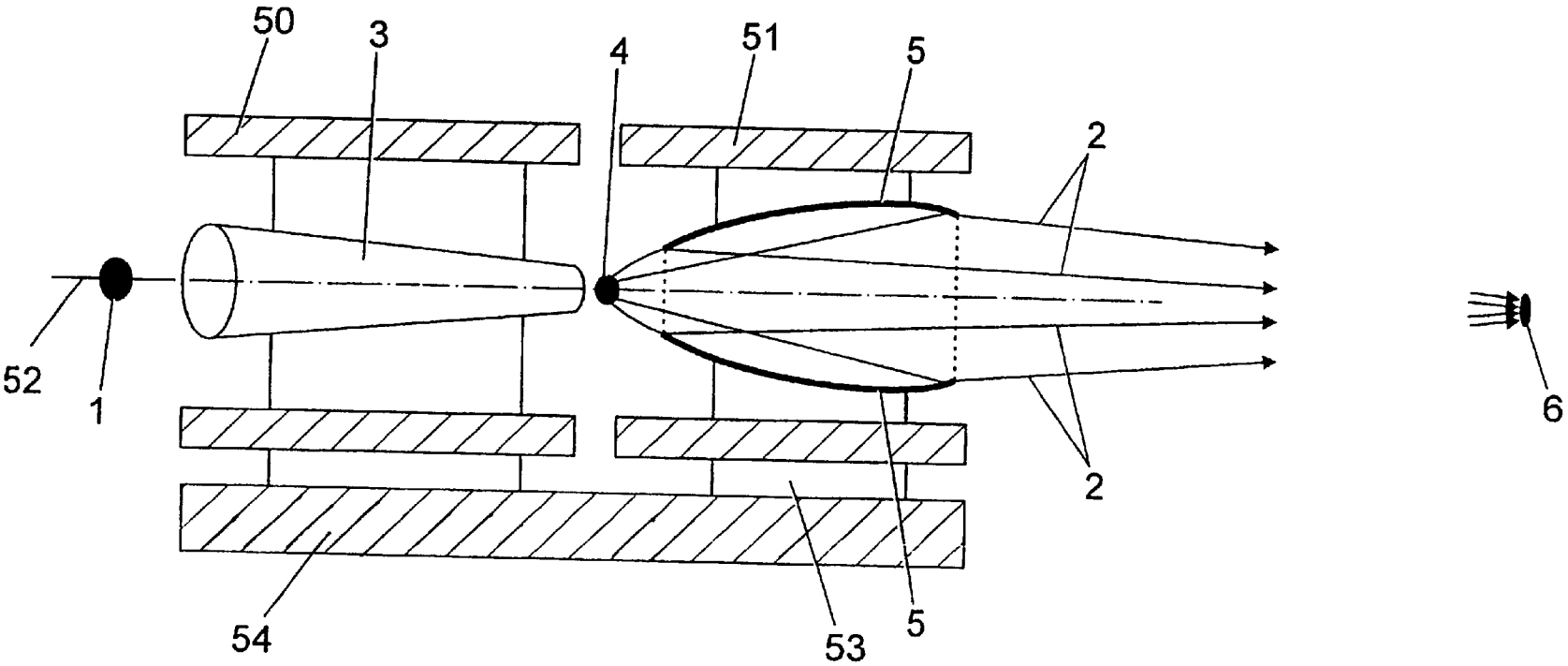
FIG. 1 shows a first embodiment of the present invention, wherein a Single Tapered Capillary lens (STC) is closely coupled to a X-ray focusing mirror.

With reference to FIG. 1, a first embodiment of the present invention is shown, wherein an X-ray generator (not shown) produces an X-ray source 1 on a target of a particular dimension. A single tapered capillary (STC) 3 acts as a waveguide and is positioned close to the source 1 to collect the X-rays from the source 1. The STC 3 produces a "virtual" focus 4 at the exit aperture of the STC. An X-ray focusing mirror 5 is closely coupled to the "virtual" focus point 4 to produce a focused X-ray beam 2 which is focused to a focal point 6.

The schematic arrangements for the housing of the STC lens 3 and mirror 5 can also be seen. The STC lens 3 and mirror 5 are aligned with each other and are fixed within separate cylindrical housings 50,51. The housings 50,51 may further be contained in an outer housing (not shown) which may be partially evacuated. The apparatus allows alignment of the mirror 5 relative to the STC lens 3 along the beam axis 52 by means of a control mechanism 53. Alignment of the whole assembly relative to the X-ray source 1 is possible by means of a control mechanism 54.

The control mechanisms 53,54 allow fine adjustment of the position of the housing 51 and also the whole assembly in the x, y, and z directions so that the axis of the mirror 5 is accurately aligned with the X-ray source 1. The mechanisms 50,51 may comprise any suitable mechanisms which permit fine translational adjustment, such as lead screws or Vernier controls.

Figure 4:
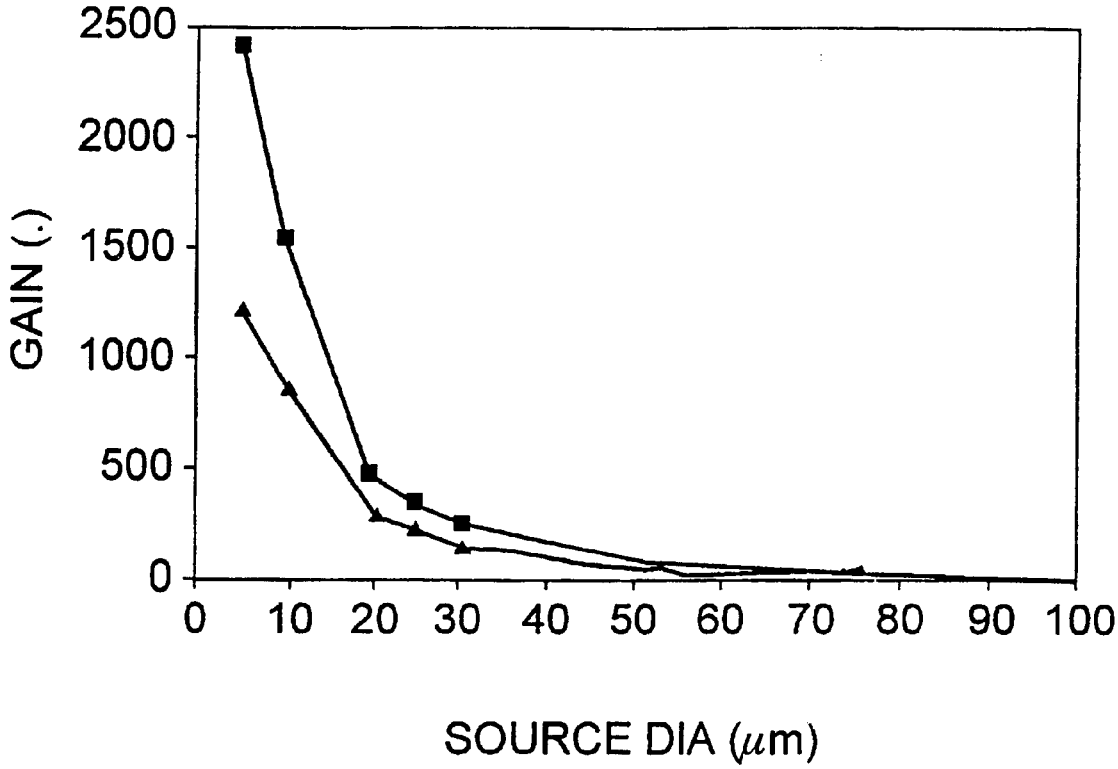
FIG. 4 is a graph showing the variation in gain against the reduction in diameter of the source beam.

As shown in FIG. 4, as the diameter of the focal spot 4 decreases, the gain in intensity through the X-ray focusing mirror 5 increases significantly, especially when the diameter of the focal spot 4 is less than 25 $\mu$m. Whilst there is a significant loss of intensity through the STC lens 3, tests have shown that the increased gain in intensity from the X-ray focusing mirror 5 is higher than the losses in the STC lens 3. In addition, the use of an STC lens 3 also allows the X-ray generator to run with a larger focal spot at the X-ray source (typically 100 $\mu$m) and at higher powers than are presently possible, giving a ten fold increase in X-ray brightness.

The combination of increased power loading and increased mirror efficiency more than balances the losses in the STC lens 3 and produces a net gain of one order of magnitude in intensity when compared to the situation in which the X-ray focusing mirror 5 alone is coupled directly to the X-ray source of the X-ray generator. It is envisaged that the X-ray focusing mirrors may be used with standard sealed tube and rotating anode sources.

The STC has a tapering internal profile such that the focal spot dimensions of the X-ray source 1 are reduced. The entry diameter of the capillary is of the same magnitude as the diameter of the source, typically 100 $\mu$m, while the exit diameter of the capillary should be as small as possible, typically 10 $\mu$m or less. The angle of convergence of the capillary should be kept as small as possible to minimise X-ray losses through the capillary walls. Typically the angle of convergence should be 10 mrad or less. The angle of convergence may be uniform (ie linear tapering) or the longitudinal profile may be ellipsoidal.

The entry aperture of the mirror 5 is optimally placed at a distance from the exit aperture of the capillary which is equal to the input focal length of the mirror. The input focal length of the reflecting mirror should be a minimum.

The use of the mirror 5 and the capillary 3 in combination leads to a net gain in the brightness of the X-ray beam at the focus 6 of the mirror 5 since the mirror focuses much more efficiently with smaller focal spot 4 dimensions. In addition the use of the mirror 5 and the capillary 3 in combination allows a larger diameter X-ray source to be used, leading to a higher power loading of the X-ray target and a higher total energy delivered to the focus 6 of the mirror 5.

Figure 2:
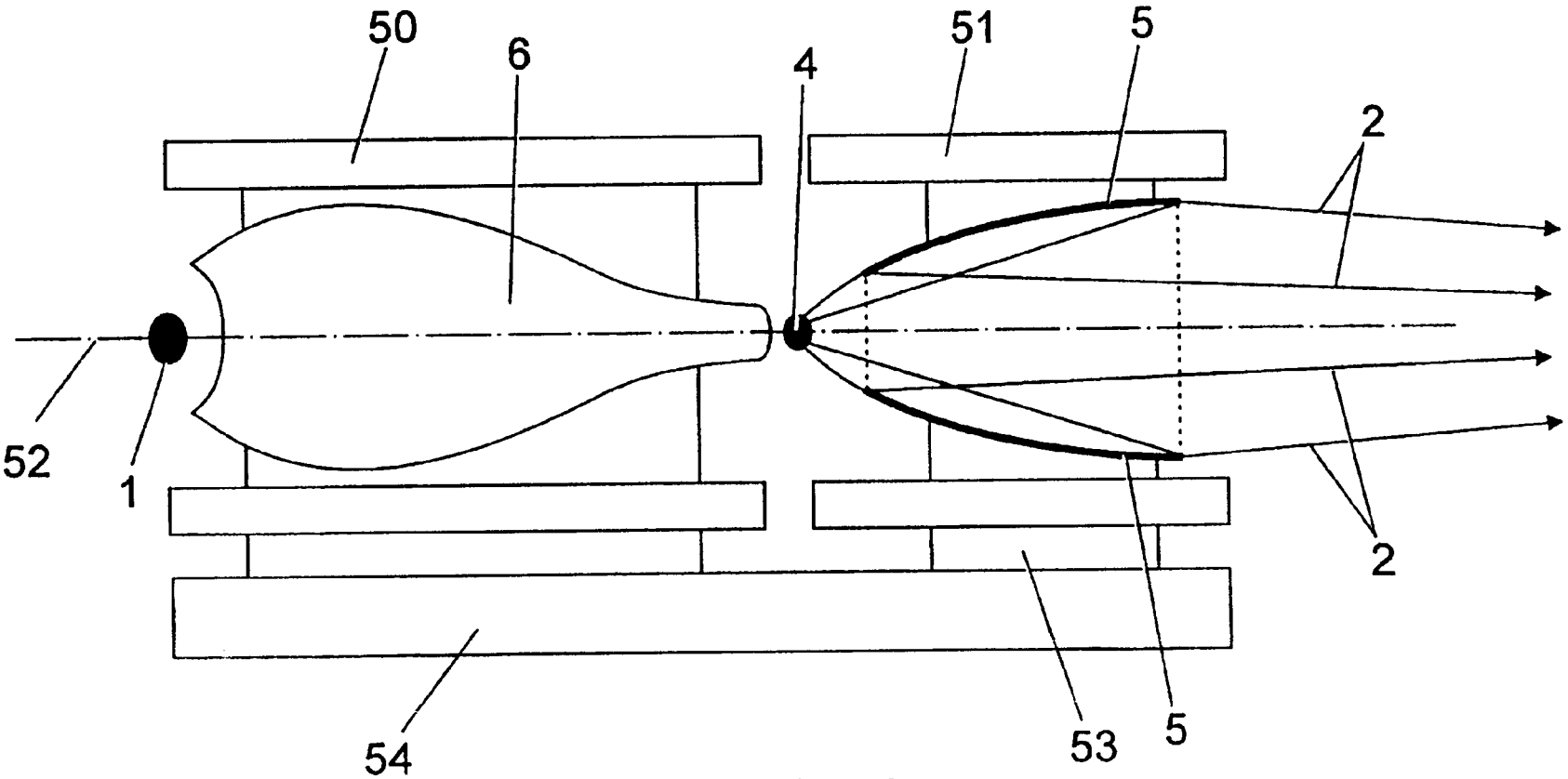
FIG. 2 shows a second embodiment of the present invention, wherein a specifically profiled Tapered Polycapillary lens (TPC) is closely coupled to a X-ray focusing mirror.

With reference to FIG. 2, a second embodiment of the present invention is shown, wherein an X-ray generator (not shown) produces an X-ray source 1 on a target. A "bottle-shaped" tapered polycapillary (TPC) lens 6 acts to both reduce the spatial size of the focal spot from the X-ray source 1 and to reduce the angular divergence of the X-rays. The TPC lens 6 is close coupled to an X-ray focusing mirror 5 and produces a "virtual" focus 4, which is then focused by the X-ray focusing mirror 5 as a focused X-ray beam 2 to the specimen (not shown) This second embodiment uses similar housings and adjustment means to those shown in FIG. 1, and are not described further.

The gain of this second embodiment is produced by three effects, namely:

(i) a higher power loading on the X-ray generator target (not shown) due to the larger allowable X-ray generator tube focal spot 1, (ii) a higher solid angle of collection of the X-ray beam 2 from the TPC lens 6 than from the X-ray focusing mirror 5 alone, and (iii) a lower divergence of the rays ("natural" divergence from a capillary is around 0.40°) and a smaller focal spot dimension which maximises the gain through the X-ray focusing mirror 5.

The approximate gains from the second embodiment are a four fold increase from the increased tube target power loading, a three fold increase due to the smaller, lower divergence spot 4 delivered to the X-ray focusing mirror 5, and a five fold increase due to the higher solid angle of collection on the TPC lens 6 (allowing for losses in the TPC lens 6).

Typically the source 1 is about 100 μm in diameter, while the virtual focus is less than 10 μm in diameter. In one example the TPC lens comprises about 100 fibres arranged in a bundle with an overall diameter of between 100 and 200 μm at entry, increasing to between 200 and 400 μm at an intermediate point and tapering to 2 to 15 μm at exit. Each individual fibre making up the TPC has an inner diameter which varies from 1 to 40 μm. Polycapillary lenses comprised of individual capillaries with diameters of around 10 μm are commercially available now. With improvements to current technology it is reasonable to expect that capillary diameters of less than 10 μm can be achieved.

Figure 3:
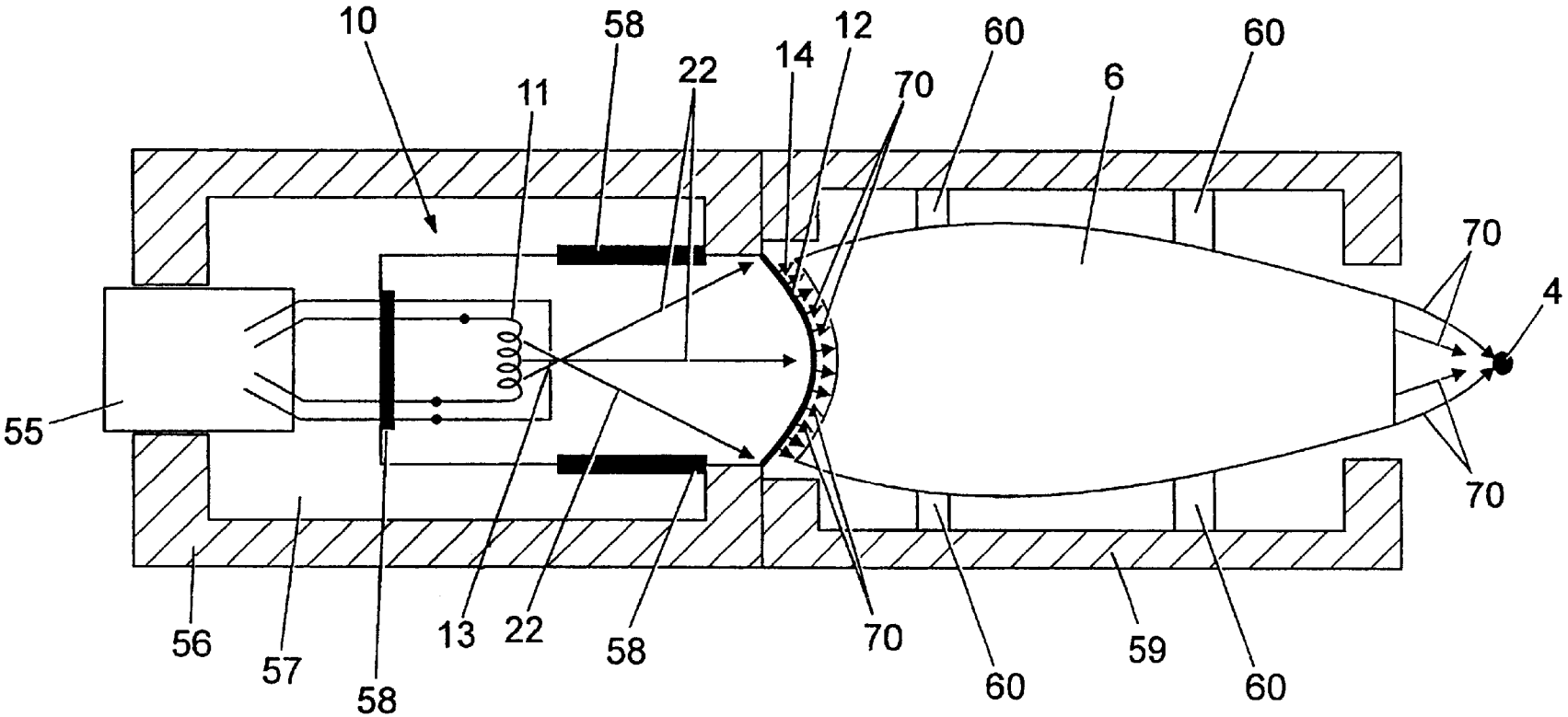
FIG. 3 shows a third embodiment of the present invention, wherein a novel X-ray generator is closely coupled to a TPC.

With reference to FIG. 3, a third embodiment of the present invention is shown, wherein a novel design of X-ray generator 10 is closely coupled to an X-ray optic in the form of a TPC lens 6 similar to that shown in the second embodiment of the present invention. The X-ray generator 10 comprises an electron gun 11 producing accelerated electron beams 22 through a Wehnelt grid 13 and a transmission target 12 thus producing X-rays 70. The target 12 has a surface which is curved in two perpendicular directions. It is to be understood that the surface may be curved in only one axis or indeed may be substantially planar or composed of a number of planar or curved portions in the form of a polyhedron. The tapered polycapillary lens is close coupled to the target 12, and a gas flow 14 is introduced between the target 12 and the TPC lens 6 in order to provide cooling for the target 12. A possible variation of this third embodiment would be the direct coupling of the X-ray generator 10 to an X-ray focusing mirror 5, which would also deliver significant gains.

The X-ray generator 10 of the third embodiment is located within a housing 56 and powered via a high voltage connector 55. To provide insulation, the X-ray generator 10 is provided with both insulator plates 58, which may be manufactured from either glass or a ceramic material, and also an insulating potting compound 57 located between the housing 56 and the X-ray generator 10.

The TPC lens 6 is located within an optics housing 59 adjacent the generator housing 56. The TPC lens 6 is held within the optics housing 59 by way of a number of adjustable mountings 60, which permit the position of the TPC lens 6 to be adjusted in the x, y, and z directions so that the lens 6 is accurately aligned with the X-ray source.

This third embodiment produces gain by spreading the X-ray source over a much greater surface area which thereby allows for much higher power loading, whilst still retaining the gain of the X-ray optic 6. In this way it is possible to produce extremely simple, compact high power X-ray generators. In addition, the X-ray optic 6 can be tailored to deliver a beam 2 of varying spatial and angular characteristics, which may then be coupled to an X-ray focusing mirror 5 in the manner described in the first and second embodiments.

In the apparatus according to the third embodiment a point source at a given distance from an x-ray optic, such as the polycapillary lens, can be replaced by an extended source next to the optic, provided the solid angle of collection is the same. Whilst extending the source in this way does not increase the efficiency of the optic per se, it allows each part of the extended source to operate at a power loading (power per unit area) of the same order of magnitude as the power loading of a smaller "point" source. Because the extended source has a larger area allowing a total power of typically several kW, compared to a typical point source of 25 W, the generator can run at much higher operating powers.

Figure 5:
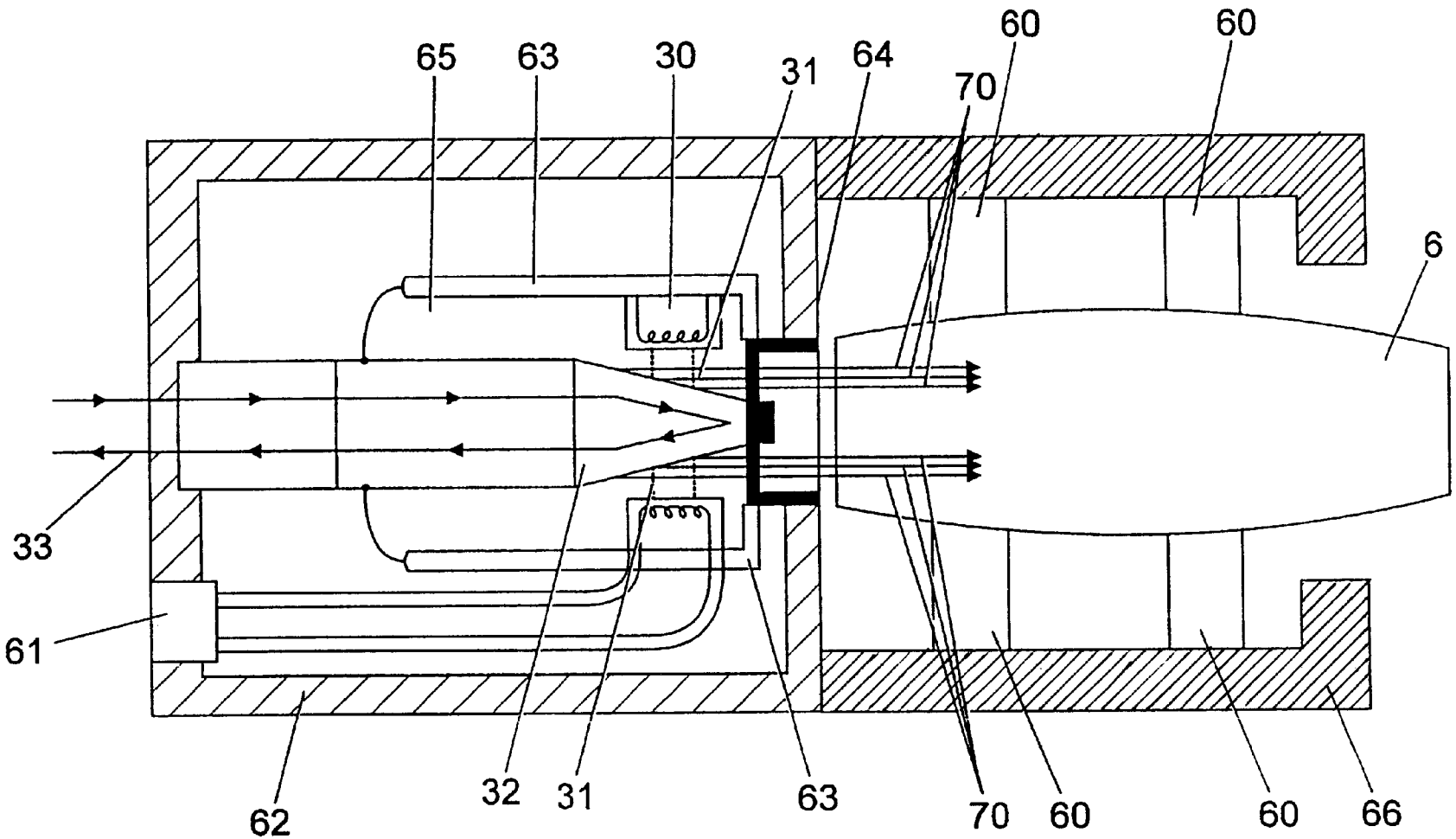
FIG. 5 shows a particular embodiment of the apparatus of FIG. 3 using a tapered conical target.

In the example of FIG. 3 the target 12 is shaped as part of a hemisphere. Other geometries are possible, for example the target may be shaped as a truncated cone, as shown in FIG. 5. The entry aperture of the PCL has a shape which corresponds to that of the target.

The embodiment of FIG. 5 uses an annular filament 30 as an electron source. The filament 30 fires electrons 31 onto a tapered target 32 which is shown as a truncated cone which is encircled by the coaxial circular annular filament 30. The optic (PCL or X-ray focusing mirror) 6 is close coupled to the target 32, which may be cooled by water 33. The filament 31 and target 32 are located in a vacuum 65 which is enclosed by an annular ceramic disk 63, whilst the generated X-rays 70 exit through an annular beryllium exit window 64 in order to maintain the vacuum 65.

As with the previous embodiments, the generator is located within a housing 62 and is powered via a high voltage connector 61. The optic 6 is also housed in an optics housing 66 which is similar to those described in the other embodiments, with adjustable mountings 60 for adjustment of the optic 6 in the x, y, and z directions.

Figure 6:
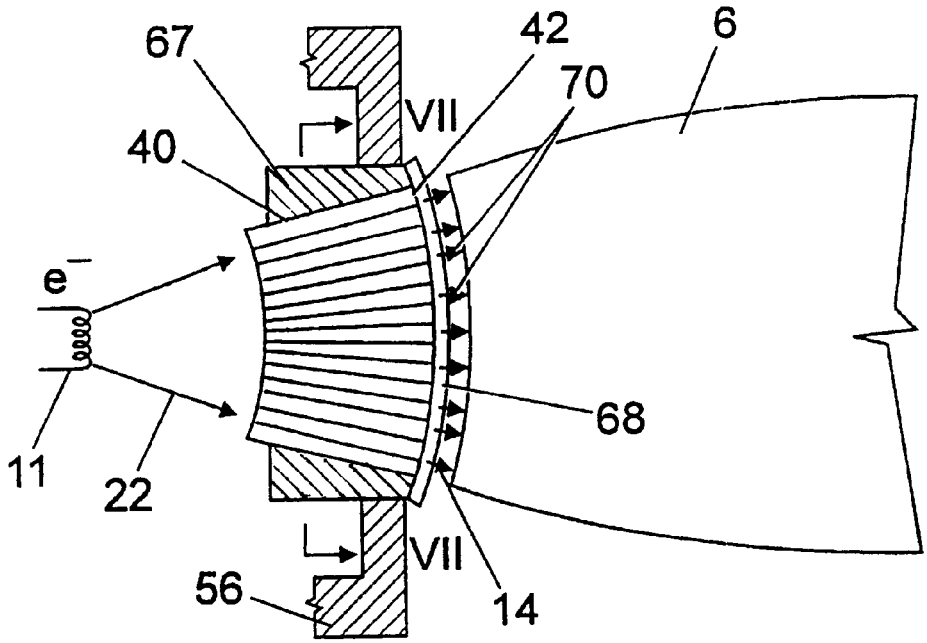
FIG. 6 shows a particular embodiment of the apparatus of FIG. 3 using a hemispherical microchannel target.
Figure 7:
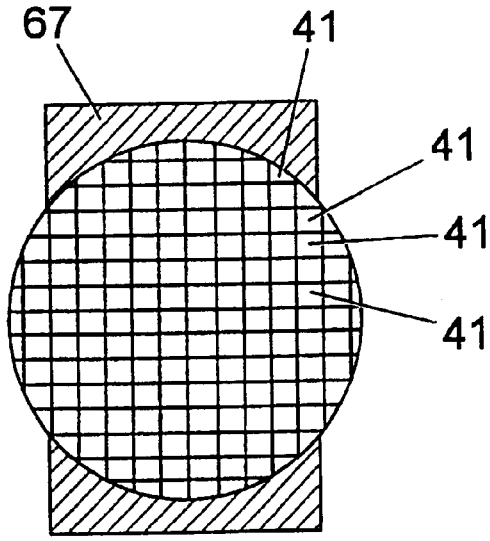
FIG. 7 shows a section along line VII—VII of the microchannel target of the apparatus of FIG. 6.

The embodiment of FIG. 6 is located in a housing 56 such as that described in FIG. 3, and uses as a target a hemispherical microchannel plate 40 coated with target material and held in place by a plate holder 67. The plate 40 comprises a number of capillaries or channels 41, seen more clearly in FIG. 7, which themselves form targets and direct the x-rays 70 caused by the incidence of the electrons on the surface of the target towards the close coupled optic 6. Alternatively the outer surface 42 only of the plate 40 may be coated with target material. So as to maintain the vacuum within the tube housing 56, a curved beryllium window 68 is attached to the housing 56.

These and other modifications and improvements can be incorporated without departing from the scope of the invention.

What is claimed is:

1. An x-ray focusing device comprising a polycapillary waveguide arranged on a first axis coupled to an x-ray focusing single reflection mirror, whereby the mirror comprises an interior reflecting surface having a rotational axis of symmetry on a second axis, said first and second axes being collinear.

2. An x-ray focusing device according to claim 1, wherein said waveguide comprises a plurality of tapered capillaries arranged symmetrically about said first axis.

3. An X-ray focusing device according to claim 2, wherein the angle of taper of said tapered capillaries is less than 10 mrad.

4. An x-ray focusing device according to claim 3, wherein the polycapillary waveguide is arranged to produce a focused x-ray beam of less that 10 μm diameter.

5. An X-ray focusing device according to claim 1, wherein said capillaries comprise tubes having internal diameters of less than 10 μm.

6. An X-ray focusing device according to claim 5, wherein said capillaries comprise tubes having internal diameter of less than 2 μm.

7. An x-ray focusing device according to claim 1, wherein said polycapillary waveguide comprises between 10 and 500 tapered capillaries.

8. An x-ray focusing device according to claim 7, wherein said polycapillary waveguide comprises between 50 and 200 tapered capillaries.

9. An x-ray focusing device according to claim 1, wherein said polycapillary waveguide has an overall diameter which first increases and then decreases with increasing distance from the x-ray source.

10. An x-ray focusing device according to claim 1, wherein said mirror is moveable in position relative to said waveguide.

11. An X-ray focusing device according to claim 10, wherein the device further comprises a guide means for guiding said mirror in a direction parallel to the second axis, and adjustment means for adjusting the spacing of the waveguide and the mirror.

12. An x-ray focusing device according to claim 10, wherein said device further comprises angular adjustment means adapted to allow angular adjustment of the mirror.

13. An x-ray focusing device according to claim 1, wherein said mirror is fixed in position relative to said waveguide.

14. An x-ray focusing device according to claim 1, wherein the polycapillary waveguide is coupled to an x-ray target of an x-ray generator, said polycapillary waveguide comprising a plurality of tapered capillaries arranged such that the input end of each capillary is arranged normal to the adjacent portion of said x-ray target.

15. An x-ray focusing device according to claim 14, wherein said X-ray target is planar.

16. An X-ray focusing device according to claim 14, wherein said X-ray target is non-planar.

17. An x-ray focusing device according to claim 14, wherein said polycapillary waveguide is arranged such that its overall diameter first increases and then decreases with increasing distance from the x-ray source.

18. An x-ray generating device comprising an annular electron source arranged about an x-ray target closely coupled to an x-ray focusing device, wherein said x-ray focusing device comprises a polycapillary waveguide arranged on a first axis coupled to an x-ray focusing single reflection mirror, whereby the mirror comprises an interior reflecting surface having a rotational axis of symmetry on a second axis, said first and second axes being collinear.

19. An X-ray generating device according to claim 18, wherein said X-ray target is tapered.

20. An X-ray generating device according to claim 18, wherein said X-ray target is conical.

21. An x-ray generating device according to claim 18, wherein said x-ray target acts as said waveguide and directs the x-ray to the x-ray focusing mirror.

22. An x-ray generating device comprising a hemispherical x-ray target closely coupled to an x-ray focusing device, wherein said x-ray focusing device comprises a polycapillary waveguide arranged on a first axis coupled to an x-ray focusing single reflection mirror, whereby the mirror comprises an interior reflecting surface having a rotational axis of symmetry on a second axis, said first and second axes being collinear, and wherein the target comprises a plurality of channels axially orientated towards the hemispherical centre.

23. An X-ray generating device according to claim 22, further comprising an electron source positioned at the hemispherical centre of the X-ray target.

24. An x-ray generating device according to claim 22, wherein the focusing device is arranged such that the angle of collection of the focusing device is the same as the angle subtended by the hemispherical target at the hemispherical centre.

* * * * *